US005496016A

United States Patent [19]

Parisien

[11] Patent Number: 5,496,016

[45] Date of Patent: Mar. 5, 1996

[54] FENCE SYSTEM

[75] Inventor: Harvey E. Parisien, Kingston, Canada

[73] Assignee: Alcuf Inc., Kingston, Canada

[21] Appl. No.: 273,984

[22] Filed: Jul. 12, 1994

[30] Foreign Application Priority Data

Jul. 19, 1993 [CA] Canada ..... 2100853

[51] Int. Cl.[6] ..... F04H 17/14

[52] U.S. Cl. ..... 256/68; 256/65; 256/59

[58] Field of Search ..... 256/65, 59, 68, 256/69, 64, 24, 31, 70, 21, 22, 55, 56

[56] References Cited

U.S. PATENT DOCUMENTS

| | | | |
|---|---|---|---|
| 351,244 | 10/1886 | Baines | 256/64 |
| 361,880 | 4/1887 | Landis | 256/64 X |
| 398,698 | 4/1889 | Brown | 256/59 |
| 2,240,689 | 5/1941 | Denton | 256/59 |
| 2,642,269 | 6/1953 | Daniel | 256/24 X |
| 2,669,434 | 2/1954 | White . | |
| 2,963,275 | 12/1960 | Meyers | 256/68 X |
| 3,057,601 | 10/1962 | De Roy Simpson | 256/64 |
| 3,352,541 | 11/1967 | Thom | 256/59 X |
| 3,604,687 | 9/1971 | Moore | 256/65 |
| 4,037,788 | 7/1977 | Riley | 256/65 X |
| 4,078,772 | 3/1978 | Carbone | 256/65 X |

FOREIGN PATENT DOCUMENTS

| | | | |
|---|---|---|---|
| 889055 | 12/1971 | Canada . | |
| 1219679 | 5/1960 | France | 256/65 |

*Primary Examiner*—Kenneth J. Dorner
*Assistant Examiner*—Harry C. Kim
*Attorney, Agent, or Firm*—Robert G. Hendry; Robert A. Wilkes

[57] ABSTRACT

A fence system including posts for supporting horizontal rails and infill material such as panels or wooden boards. The posts comprise spaced-apart channel members of substantially C-shaped cross-sections having channels facing inwardly. The rails extend between the channel members of the post. A connector having side edges bent to engage interned flanges of the channel members is held in place by a bolt and washer. An alternative connector in the form of a band clamps at least the upper ends of the channel member of the post together and preferably supports the rails. The lower ends of the channel members of the post are preferably set in concrete or secured to a base.

3 Claims, 4 Drawing Sheets

FENCE SYSTEM

This invention relates to barriers and more particularly to fences having horizontal rails supported by metal posts.

Wooden fences are often preferred over chain link fences for reasons of aesthetic appeal, or greater privacy even though wooden fences are more expensive and require greater maintenance.

It is, therefore, desirable to provide a wooden fence which requires less skilled labour to construct and less maintenance due to the fact that rotting of rails and posts is reduced.

Attempts to provide a double post fence include a stockyard fence disclosed in U.S. Pat. No. 2,669,434 issued to W. E. White. This fence was not entirely suitable for replacing a residential wood fence system.

A residential fence system including bifurcated posts set in a concrete base, and horizontal rails passing through the posts was disclosed in Canadian Patent 889,055 issued to Rudolph E. Parisien. It was pointed out in this patent that there are advantages to be gained by passing top and bottom rails through the post these advantages include elimination of cutting and fitting rails between posts.

However, the prior attempts to provide a double post fence system have not been entirely satisfactory in that accurate positioning of the upright members in the concrete base is necessary otherwise on site drilling would be required to provide aligned apertures extending through both upright post members.

It is, therefore, desirable to provide a connector for securing two post members together which requires no holes to be drilled in the posts. The connector further provides a vertically adjustable support for the horizontal rails.

A further advantage of the connectors of this invention is that in one mode of operation it is used to align a pair of post members during pouring of the concrete base in which the members are embedded.

A still further advantage of the fence post connector of this invention is that post members are wedged against wood rails so that passing bolts through the posts is unnecessary. It is also desirable to eliminate nails, screws or similar means for fastening wooden rails to posts.

BRIEF STATEMENT OF THE INVENTION

Accordingly, the present invention provides a plurality of vertical posts supporting top and bottom rails, the post comprising parallel spaced-apart channel members having lower ends embedded in concrete, a connector comprising a body, an aperture in the body to receive a bolt, a pair of ribs on the body, one of the ribs on each side edge of the body to engage flanges on the channel members, and a washer on the bolt for engaging side walls of the channel members of the post when the post is assembled.

DESCRIPTION OF THE DRAWINGS

In the drawings which illustrate a preferred embodiment of the invention.

DETAILED DESCRIPTION OF THE INVENTION

Figure 1:
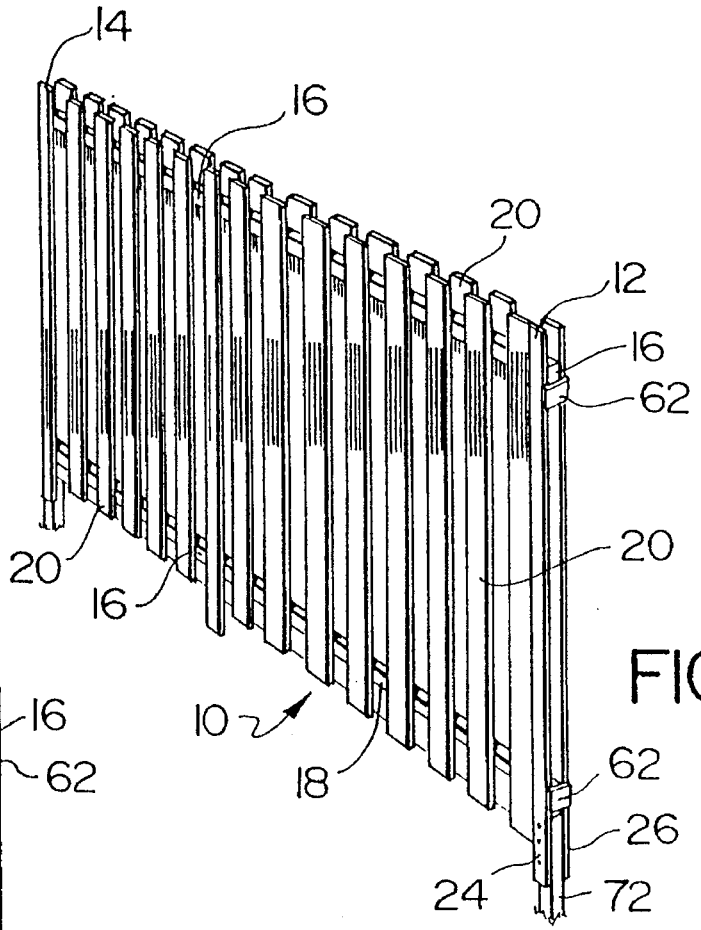
FIG. 1 is a perspective view of a fence system in accordance with the invention.

Referring now in detail to the accompanying drawings a fence system shown generally at 10 in FIG. 1 includes vertical posts, two of which are shown at 12 and 14 for supporting a top rail 16 and a bottom rail 18 to which fence infill material 20, in this case wooden slats, is secured.

Since rails 16 and 18 pass through posts 12 or 14, it is not necessary to have posts 12 or 14 at regular intervals, and rails 16 and 18 may be spliced as required. Unforseen problems in providing post holes at exact intervals can be avoided. Vertical adjustment of the rails during construction, and for maintenance purposes due to heaving of posts 12 and 14 caused by ground movement, is facilitated by the vertically adjustable connectors 50 which can be released to move rails 16 and 18 relative to posts 12 and 14.

As shown more clearly in FIG. 2 each post 12 comprises parallel spaced-apart channel members 24 and 26 having their lower ends embedded in concrete base 28 constructed below grade and preferably extending below the frost line in northern areas.

Figure 3:
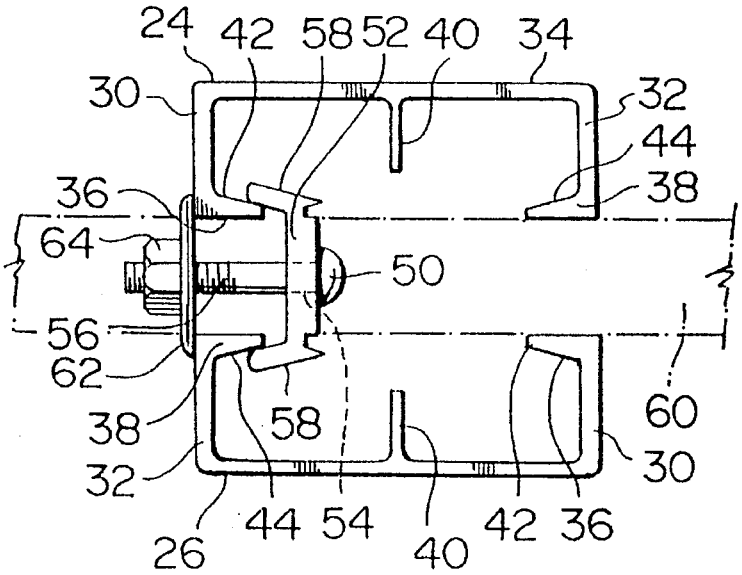
FIG. 3 is a top plan view of the post of FIG. 2 showing a top rail in dashed lines.
Figure 4:
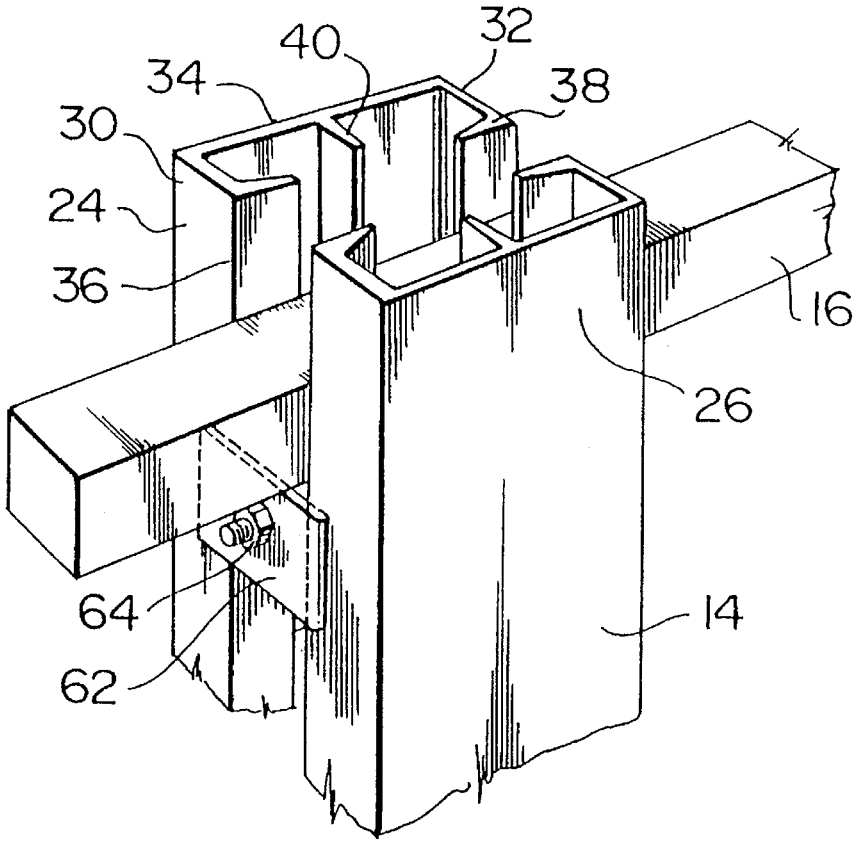
FIG. 4 is a perspective view of a section of a top rail and a post having the connector of this invention installed thereon.
Figure 5:
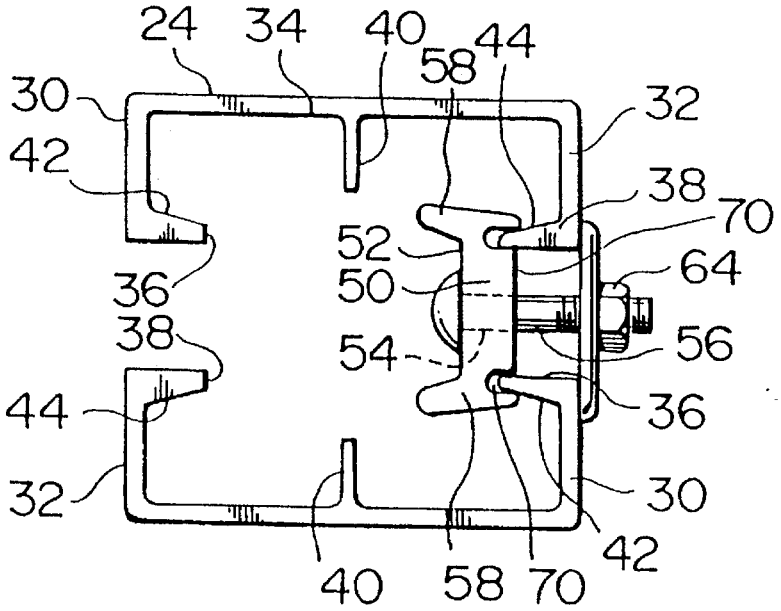
FIG. 5 is a top plan view of the post of FIG. 2 of the fence post held in position while concrete is poured.

The channel member 24 and 26 are of identical C-shaped cross-section and only one channel member will be described in detail as shown in FIGS. 3, 4 and 5. The channel member 24 has two side walls 30 and 32 and an interconnecting wall 34. The outer edges of the walls 30 and 32 are turned inwardly to provide integral ribs or flanges 36 and 38 on the walls 30 and 32 respectively. A reinforcing rib 40 is also provided on the inner face of the connecting wall 34 if required.

It will be noted that the flanges 36 and 38 have angled inner faces 42 and 44 so as to be at an angle of approximately 95° to 100° relative to the side walls 30 and 32 respectively.

The channel members 24 and 26 are held together at the upper end by one or more connectors 50 as shown in FIG. 3. The connector 50 has a body 52 having a centrally located aperture 54 to receive a bolt 56. The side edges of the body 52 are bent substantially at right angles to provide flanges 58 to cooperate with surfaces 42 and 44 of the flanges 36 and 38 of the channel members 24 and 26.

As shown in FIG. 4 the assembled post 14 includes channel members 24 and 26 supporting a rail 16 of wood, metal or other suitable material (shown in dashed lines in FIG. 3). As shown in FIG. 5, the connector 50 includes a washer 62 received on the bolt 56 and engaging the channel members 24 and 26. A retaining nut 64 is received on the end of the bolt 56.

During assembly of the post 14, and the pouring of the concrete base 28, the channel members 24 and 26 are conveniently held in parallel spaced apart relationship by the connector 50 which is temporarily reversed and bolted in place as shown in FIG. 5. It will be appreciated that parallel grooves 70 in the body of the connector 50 engage the flanges 36 and 38 of the channel members 24 and 26 to provide accurate alignment during pouring and hardening of the concrete base 28.

Alternatively, the channel members 24 and 26 can be fastened to a stub post 72 (shown in FIG. 1) driven into the ground or embedded in a concrete base, and it is considered that such a construction for the post 14 would be within the scope of the invention.

Figure 6:
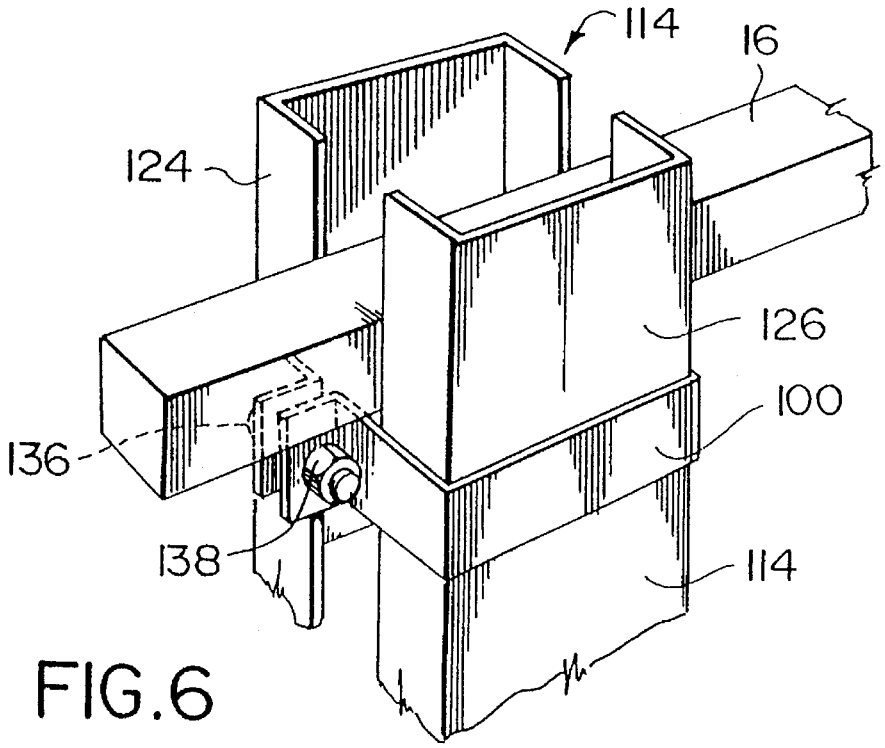
FIG. 6 is a perspective view of an alternative construction of the fence system.
Figure 7:
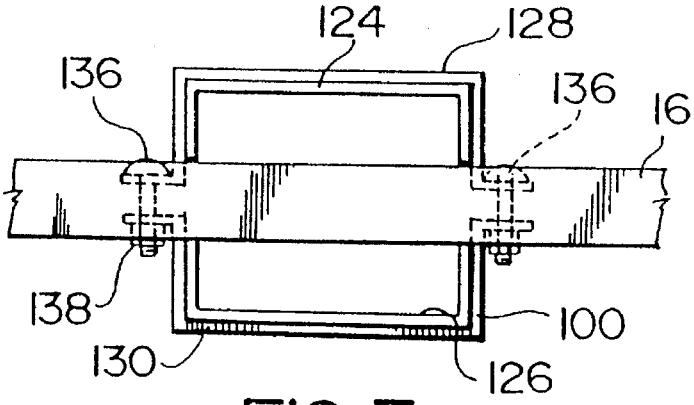
FIG. 7 is a top plan view of a fence system.

As shown in FIGS. 6 and 7, a clamp or band 100 is substituted for the connector 50 of FIG. 1. The post 114 includes channel members 124 and 126 supporting the rail 16. The band 100 is preferably formed in two pieces 128, 130 held together by bolts 136 and retaining nuts 138.

Figure 8:
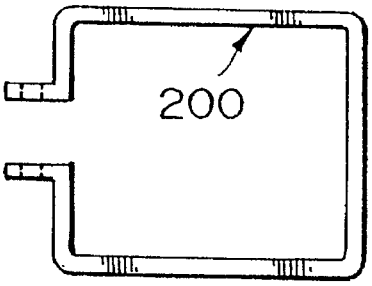
FIGS. 8 and 9 are alternative constructions of the band of FIG. 6.
Figure 9:
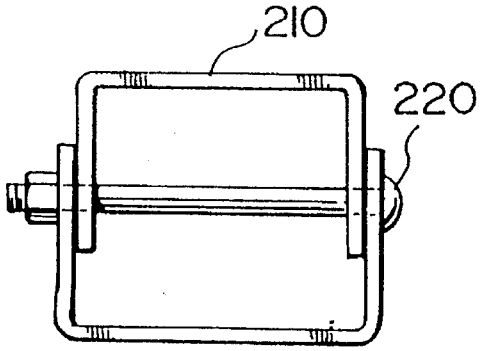
Figure 10:
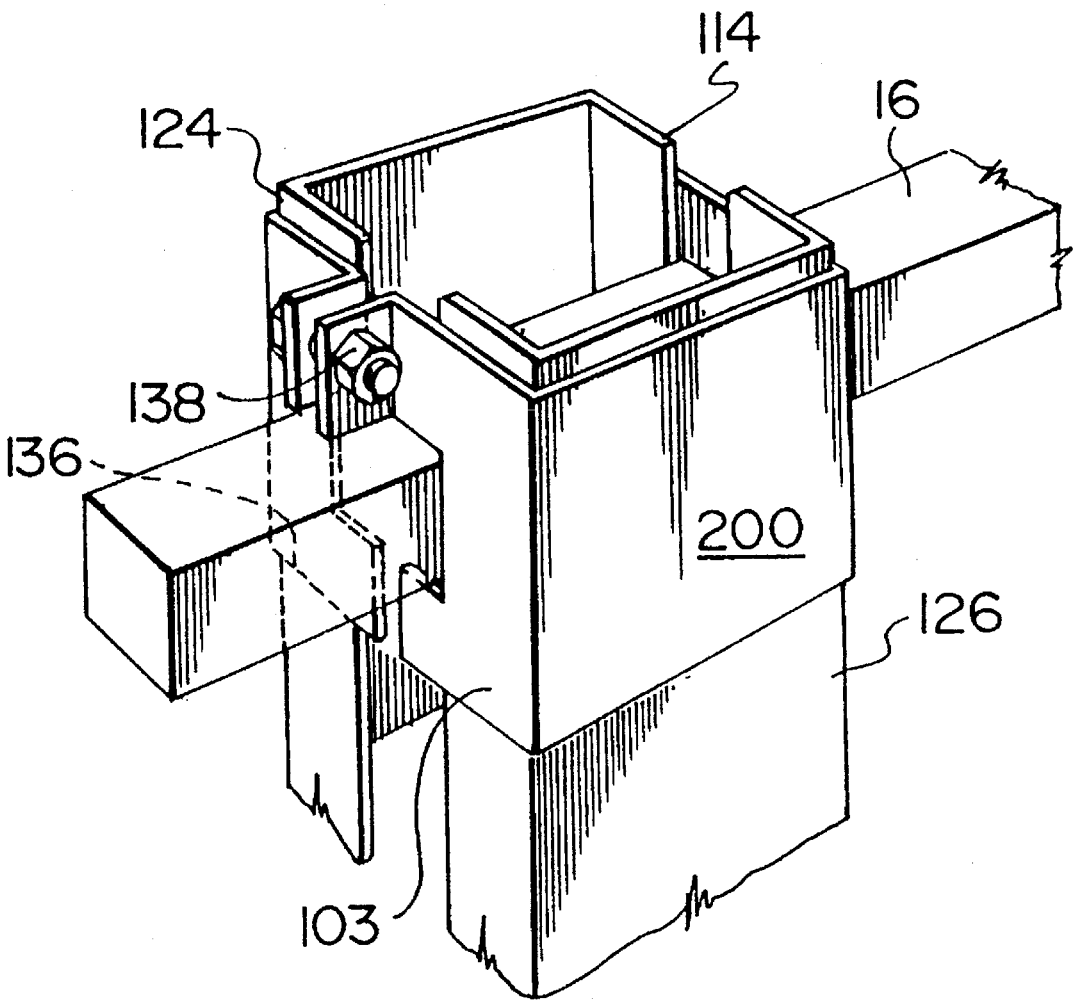
FIG. 10 is a perspective view of an alternative construction including a rail hanger.

It will be appreciated that the construction of the band 100 may vary and two variations are shown at 200 and 210 in FIGS. 8 and 9 respectively. The band 200 is similar to the band 100 of FIG. 6 although it is adapted for use with a single bolt 136. The band 210 is a two piece band having a single bolt 220 extending therethrough. Alternatively, as shown in FIG. 10 the band 200 may include a hanger 103 for suspending the rail 10.

Figure 2:
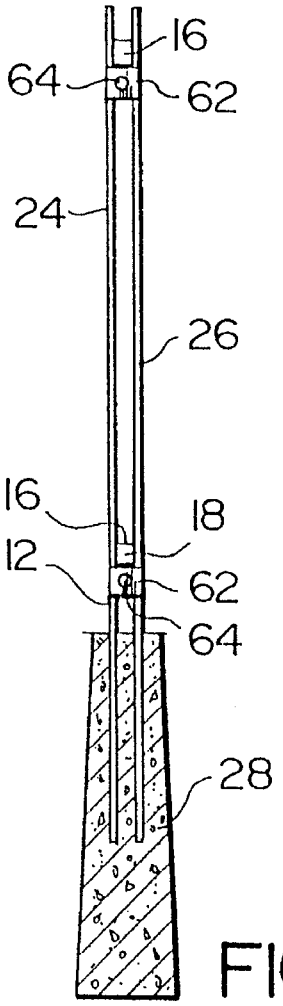
FIG. 2 is an end view of the fence of Figure showing a concrete base attached to a line post.

When using bands 100, 200 or 210 instead of brackets 50, rather than the bands having the dual purpose of acting as fastener and installation spacing tool, this construction required either the actual rails to be positioned within the posts, or a temporary block of rail to be positioned within the posts which posts are being installed in a concrete base 28 (FIG. 2).

I claim:

1. In a fence system including a plurality of vertical posts supporting top and bottom rails, each post comprising:

parallel spaced-apart channel members having opposed channels and lower ends secured to a base, wherein each channel member has first and second side walls and an interconnecting wall, wherein free ends of each of the side walls being turned inwardly to form a pair of flanges having side faces parallel to the interconnecting walls to define a channel opening for accommodating the rail therein;

a connector comprising a body;

an aperture in the body to receive a bolt;

a washer received on the bolt for engaging said side walls of the channel members of the post;

a pair of ribs on the body, one of the ribs being disposed on each side of the body to engage the flanges on the channel members when the bolt is tightened to urge the channel members for engaging and clamping the rail therebetween; and when the post is assembled, the top and bottom rails extend between the channel members of the posts and rest on an associated connector.

2. A fence system as claimed in claim 1, wherein parallel grooves are provided on a side of the connector body remote from the ribs for engaging the flanges on the channel members of the post when the connector is reversed and clamped on the channel members to provide alignment of the channel members during construction of the base.

3. A fence system as claimed in claim 1, wherein inner side faces of the ribs are angularly disposed with respect to the body of the connector to mate with angular inner surfaces of the flanges of the channel members for urging the channel members of the post together when the post is assembled.

* * * * *